United States Patent [19]

Baugh et al.

[11] 4,440,233

[45] Apr. 3, 1984

[54] SETTING TOOL

[75] Inventors: John L. Baugh; Melvin J. Hardy, both of Huntsville, Tex.

[73] Assignee: Hughes Tool Company, Houston, Tex.

[21] Appl. No.: 395,211

[22] Filed: Jul. 6, 1982

[51] Int. Cl.[3] ..... E21B 23/02

[52] U.S. Cl. ..... 166/382; 166/124; 166/207

[58] Field of Search ..... 166/123–125, 166/181, 182, 207

[56] References Cited

U.S. PATENT DOCUMENTS

| | | | |
|---|---|---|---|
| 3,136,367 | 6/1964 | Wright et al. | 166/124 |
| 3,171,490 | 3/1965 | States | 166/124 |
| 3,171,491 | 3/1965 | States | 166/208 X |
| 3,391,742 | 7/1968 | Davis | 166/139 |
| 3,608,634 | 9/1971 | Cochran | 166/208 |
| 3,920,075 | 11/1975 | Braddick et al. | 166/290 |
| 3,934,652 | 1/1976 | Cochran | 166/283 |
| 3,991,826 | 11/1976 | Baugh | 166/120 |
| 4,388,971 | 6/1983 | Pederson | 166/124 |

*Primary Examiner*—William F. Pate, III

*Attorney, Agent, or Firm*—Robert A. Felsman; Charles D. Gunter, Jr.

[57] ABSTRACT

A setting tool of the type adapted to be made up in a pipe string for releasably engaging a setting sleeve in a well bore is shown which has a mandrel having an upper end adapted to be connected in the pipe string and having a lower end. A setting nut carried on the mandrel has external connecting threads for engaging mating connecting threads located on the interior of a setting sleeve disposed about the lower end of the mandrel. The mandrel is slidably disposed within the setting means when the setting means is engaging the setting sleeve. The mandrel is slidable between an extended running-in position and a weight-set down position. Dogs are provided in the setting nut for engaging a radial groove in the setting sleeve when the mandrel is in the running-in position to prevent relative movement between the setting nut and the setting sleeve which would disengage the tool. Setting weight down on the tool causes an undercut area on the mandrel to underlie the dogs in the setting nut thereby allowing the dogs to be disengaged from the setting sleeve groove which in turn allows relative movement between the setting nut connecting threads and the connecting threads of the setting sleeve to disengage the tool. The setting nut connecting threads can be right hand release threads, whereby the setting tool is releasable from the setting sleeve by right hand rotation of the mandrel when the mandrel is in the weight set-down position.

9 Claims, 6 Drawing Figures

SETTING TOOL

BACKGROUND OF THE INVENTION

The present invention relates generally to setting tools of the type adapted to be made up in a pipe string for releasably engaging a setting sleeve run on the pipe string into a well bore, and specifically to a setting tool which allows right hand torque to be used during well bore operations as well as right hand torque to release the setting tool from the setting sleeve.

Setting tools are used for various purposes during well drilling and completion operations. For instance, a setting tool is typically used during setting of a liner hanger in a well bfore. The setting tool is made up in the pipe string between the liner hanger and the pipe string running to the well surface. The setting tool serves as a link to transmit torque to the liner hanger to hang the liner in the well bore. The setting tool is then typically manipulated from the well surface to effect a release of the setting tool from the liner hanger and the liner is then cemented into place in the well bore.

In a typical well drilling pipe string, the lengths of pipe are connected by tool joints with right hand threads which are released by left hand torque. Drilling is thus carried out by clockwise rotation of the drill string to avoid breaking out the tool joints making up the pipe string. In certain setting tool designs, connecting threads were used to engage the setting tool with the setting sleeve which were releasable by right hand torque on the pipe string from the surface. However, this necessitated holding left hand torque on the pipe string while running into the well bore and dictated that the liner be set to the left in order to avoid releasing the setting tool connecting threads. Because left hand torque was used to set the liner, the possibility existed that tool joints in the pipe string would be unscrewed and a joint broken out.

It is, therefore, preferred to utilize a setting tool which allows the liner to be set by applying right hand torque from the surface and which allows the setting tool to be released and pulled out of the well bore by applying a similar right hand torque. Certain prior setting tool designs have achieved a right hand torque release by incorporating a J-pin mechanism in the tool. The J-pin designs have proved to be a disadvantage at times because the J-pin is not strong enough to withstand the torque applied.

There exists a need, therefore, for a setting tool which will allow right hand torque to be used during setting of a liner hanger or similar tool which also allows right hand torque to be used to release the tool.

There also exists a need for a setting tool which can transmit right hand torque during well bore operations and which is releasable by right hand torque which does not employ a J-pin release mechanism.

SUMMARY OF THE INVENTION

The present setting tool of the type adapted to be made up in a pipe string for releasably engaging a setting sleeve in a well bore has a mandrel having an upper end adapted to be connected in a pipe string and has a lower end. A setting means carried on the mandrel has external connecting means for engaging mating connecting means located on the interior of a setting sleeve disposed about the lower end of the mandrel. The mandrel is slidably disposed within the setting means when the setting means is engaging the setting sleeve. The mandrel is slidable between an extended running-in position and a weight set-down position. Latch means are operably associated with the setting means and the mandrel for preventing relative movement between the connecting means on the setting means and on the setting sleeve interior when the mandrel is in the extended running-in position and allowing relative movement between the connecting means when the mandrel is in the weight set-down position.

Preferably, the mandrel has an upper end adapted to be connected in the pipe string, a lower end, and an intermediate supporting shoulder formed on the exterior of the mandrel. A setting nut carried on the mandrel has external connecting threads for engaging mating connecting threads on the interior of a setting sleeve disposed about the lower end of the mandrel. The mandrel is slidably disposed within the setting nut when the nut is engaging the setting sleeve. The mandrel is slidable between an extended running-in position and a weight set-down position wherein the supporting shoulder contacts the setting sleeve. Torque transmitting means on the mandrel transmit torque to the setting nut.

The setting nut is preferably a generally cylindrical member having at least one axial groove in the interior thereof. The torque transmitting means comprises at least one torque transmitting spline on the mandrel exterior adapted to be received within the setting nut axial groove whereby torque transmitted to the mandrel is transmitted to the setting nut. The setting nut can have at least one opening in a sidewall thereof for receiving a dog. The setting sleeve interior has at least one groove adapted to engage the dog when the mandrel is in the extended running-in position. The dog and groove together comprise latch means for preventing relative movement between the connecting threads of the setting nut and the setting sleeve when the mandrel is in the extended running-in position.

Retaining means can be provided on the mandrel lower end for supporting the setting nut when the setting nut is engaging the setting sleeve in the running-in position.

Preferably, the mandrel exterior between the supporting shoulder and the retaining means comprises an undercut area formed by a region of reduced external diameter joined to a region of further reduced diameter. The undercut area of the mandrel is suitably positioned to underly the setting nut during sliding movement of the mandrel within the setting nut, whereby the reduced diameter region underlies and retains the dog in the setting sleeve slot when the mandrel is in the running-in position and the further reduced region underlies and releases the dog from the slot when the mandrel is in the weight set-down position.

In this way, the setting nut connecting threads can be right-hand release threads, whereby the setting tool is releasable from the setting sleeve by right-hand rotation of the mandrel when the mandrel is in the weight set-down position.

In the method of releasing a setting tool from a setting sleeve in a well bore, a mandrel is provided having an upper end adapted to be connected in the pipe string and having a lower end. Setting means are carried on the mandrel having external connecting means for engaging mating connecting means located on the interior of a setting sleeve disposed about the lower end of the mandrel. The mandrel is slidably disposed within the setting means when the setting means is engaging the setting sleeve and the mandrel is slidable between an extended running-in position and a weight set-down position. Latch means are provided on the setting means and setting sleeve for preventing relative movement between the connecting means when the mandrel is in the extended running in position and allowing relative movement in the weight set-down position. Torque transmitting means are provided on the mandrel for transmitting torque to the setting means.

The setting tool is first run into the well bore with the mandrel in the extended position and a setting sleeve engaged below the tool by the connecting means.

The setting sleeve is then manipulated to perform well bore operations by applying right hand torque to the pipe string from the surface.

Weight is then set down on the pipe string from the surface and right hand torque is applied to the tool through the pipe string to release the setting tool from the setting sleeve.

Additional objects, features, and advantages will be apparent from the written description which follows.

DETAILED DESCRIPTION OF THE INVENTION

Figure 1:
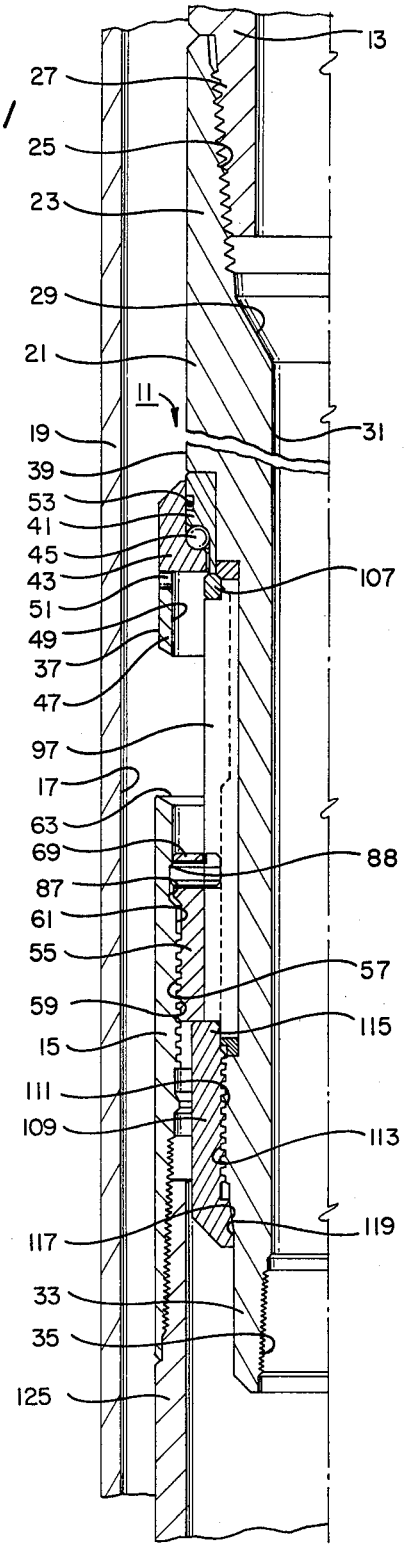
FIG. 1 is a side partial cross-sectional view of the setting tool of the invention in the running in position.

Turning to FIG. 1, there is shown a setting tool designated generally as 11 of the type adapted to be made up in a pipe string 13 for releasably engaging a setting sleeve 15 in a well bore 17. By "well bore" is meant the annular space between the setting tool 11 and the casing 19, it being understood that the well bore could be unlined, as well.

The setting tool 11 includes a tubular mandrel 21 having an upper end 23 which is internally threaded at the upper extent 25 thereof for matingly engaging the external threads of the lower extent 27 of the pipe string 13 running to the surface. The internally threaded upper extent 25 of upper end 23 is connected by means of a tapered bore 29 to an internal bore 31 which runs through the remainder of the length of the mandrel to the lower end 33 which has an internally threaded surface 35.

Mandrel 21 also has an intermediate supporting shoulder 37 formed on the exterior surface 39 thereof. As shown in FIG. 1, supporting shoulder 37 includes an upper bearing race 41, a lower bearing race 43 and a plurality of balls 45 therebetween. The lower extent 47 of supporting shoulder 37 extends downwardly from lower bearing race 43 forming an annular space 49 between lower extent 47 and the exterior surface of the mandrel 21 at that point. A port 51 provides fluid communication between the well bore 17 and the annular space 49. Lower bearing race 43 and lower extent 47 are rotatable about upper bearing race 41 and the mandrel body by means of the ball bearings 45. A trash seal 53 can be provided in the exterior of upper bearing race 41 to help prevent contamination of the ball races.

Setting means, in this case setting nut 55 is carried on the mandrel exterior below supporting shoulder 37. Setting nut 55 has external connecting threads 57 for engaging mating connecting threads 59 on the interior 61 of a setting sleeve 15 which is disposed about the lower end 33 of the mandrel 21.

Figure 2:
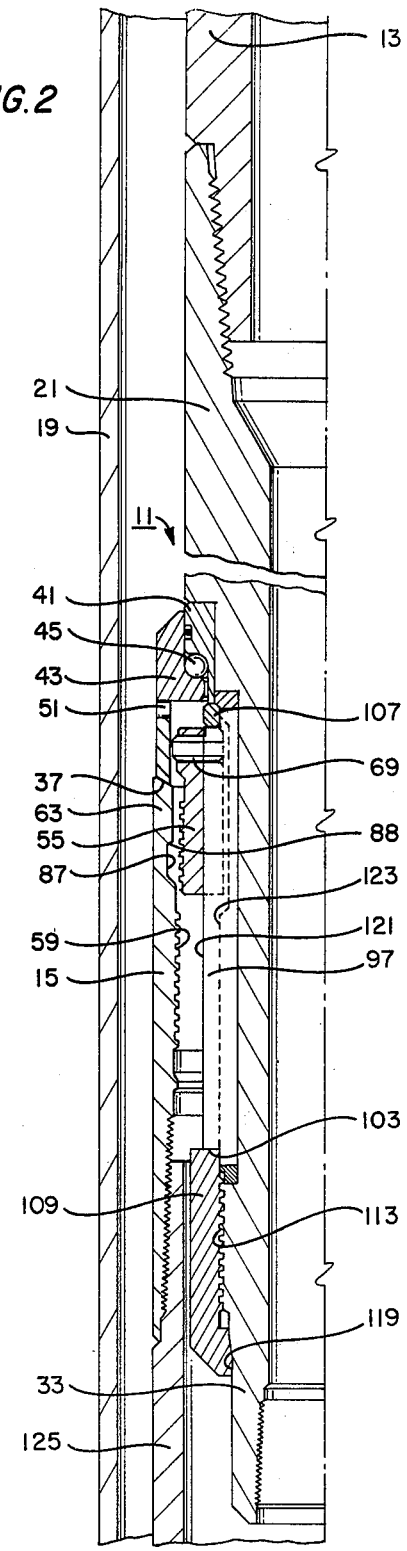
FIG. 2 is a side partial cross-sectional view of the tool of FIG. 1 in the weight set-down position showing the connecting means disconnected.
Figure 4:
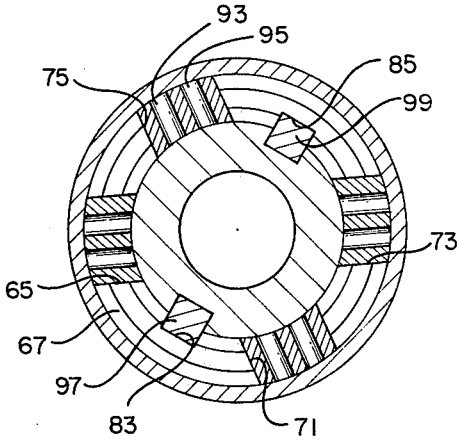
FIG. 4 is a cross-sectional view of the tool of FIG. 3 taken along lines IV-IV.

As shown in FIGS. 1 and 2, the mandrel 21 is slidably disposed within the setting nut 55 when the nut 55 is engaging the setting sleeve 15. As will be described further, the mandrel 21 is slidable between an extended running-in position shown in FIG. 1 and a weight set-down position shown in FIG. 2 wherein the supporting shoulder 37 contacts the uppermost extent 63 of setting sleeve 15. As best seen in FIG. 4, setting nut 55 is a generally cylindrical member having at least one opening 65 in a sidewall 67 thereof for receiving a dog 69. Preferably, setting nut 55 has a plurality of openings 71, 73, 75 similar to opening 65 for receiving a plurality of dogs 77, 79, and 81. Setting nut 55 is also provided with a pair of axial grooves 83, 85 spaced approximately 180 degrees apart about the internal diameter thereof.

As shown in FIG. 2, setting sleeve 15 has a radial groove 87 in the interior surface thereof appropriately spaced to engage dogs 69, 77, 79, and 81 when the connecting threads 57, 59 are engaged as shown in FIG. 1. The upper shoulder 88 formed by groove 87 in the sleeve interior 61 engages the dogs 69, 77, 79 and 81 of setting nut 55 when the mandrel 21 is in the extended, running-in position, the dogs 69, 77, 79 and 81 and groove 87 together comprising the latch means operably associated with the setting nut 55 and the mandrel 21 for preventing relative movement between the connecting threads 57, 59 of the setting nut 55 and setting sleeve 15 when the mandrel 21 is in the extended, running-in position. That is, any tendency of the nut 55 to travel up the threads 59 is prevented by the dogs 69, 77, 79 and 81 contacting shoulder 88 when the tool is in the running-in position.

Figure 5:
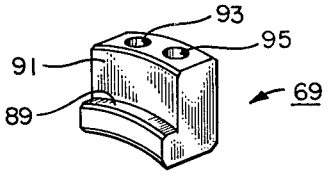
FIG. 5 is a perspective view of a dog used in the setting means of the tool of FIG. 1.

The dogs 69, 77, 79 and 81, as shown in FIG. 5, are generally L-shaped having a base region 89 of greater width and a neck region 91 of lesser width which is adapted to be slidably received within the opening 65 in setting nut 55. A pair of bores 93, 95 in each dog 69, 77, 79 and 81 provide for the passage of fluid from the interior to the exterior of the setting nut 55 during sliding movement of the mandrel 21 in the nut 55.

Figure 6:
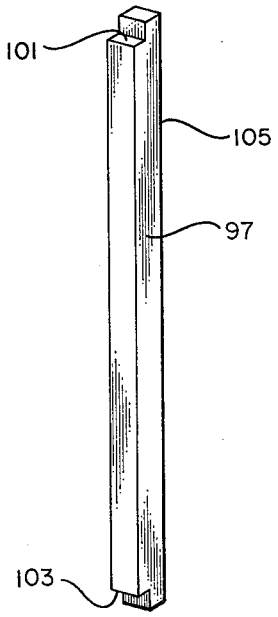
FIG. 6 is a side, perspective view of a mandrel spline of the setting tool of FIG. 1.

As shown in FIGS. 1 and 4, at least one torque transmitting spline 97 is affixed to the mandrel exterior which is adapted to be received within the setting nut axial groove 83 whereby torque transmitted to the mandrel 21 is transmitted to the setting nut 55. Preferably, a pair of splines 97, 99 are provided and fitted in axial grooves 83, 85. Each spline 97, 99 as shown in FIG. 6 is a longitudinal bar having an upper shoulder 101 and a lower shoulder 103 formed at the opposite ends thereof. The rear wall 105 of each spline 97 is fitted within the respective axial groove 83, 85 and a retaining ring 107 is received in upper shoulder 101 to retain the upper end of spline 97 within axial groove 83.

As shown in FIG. 1, a retaining means such as retaining nut 109 is located on the mandrel lower end 33 for supporting the setting nut 55 when the setting nut 55 is engaging the setting sleeve 15 in the running-in position. Retaining nut 109 has an internally threaded surface 111 adapted to matingly engage the external threads 113 on the exterior of mandrel lower end 33 and the upper end 115 of retaining nut 109 overlays a portion of axial groove 83. In this way, when retaining nut 109 is threaded onto lower end 33, the upper end of 115 of retaining nut 109 is received on lower shoulder 103 of spline 97 thereby retaining the spline lower portion within the axial groove 83. The end of retaining nut 109 opposite end 115 has a tapered interior 117 which engages an oppositely tapered surface 119 on the exterior of lower end 33 to firmly wedge the retaining nut in the threaded position shown in FIG. 1.

Figure 3:
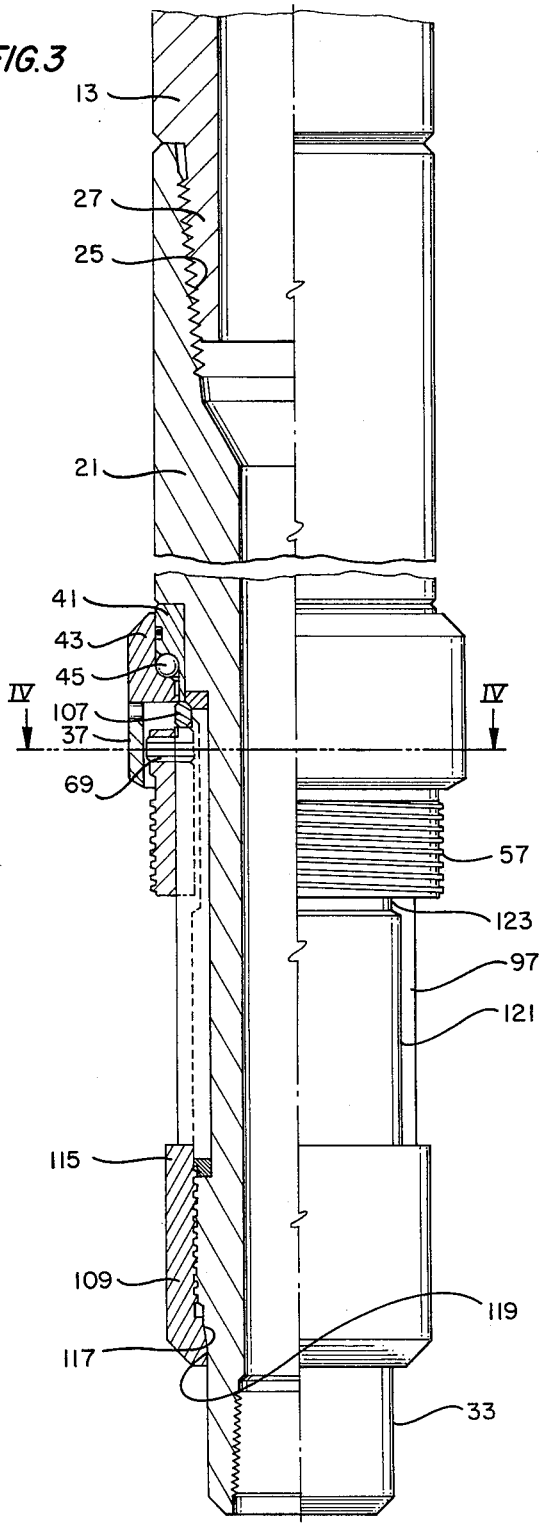
FIG. 3 is a side partial cross-sectional view of the setting tool shown connected to a pipe string and released and pulled out of the setting sleeve.

As best seen in FIG. 3, the mandrel exterior surface between the supporting shoulder 37 and the retaining nut 109 comprises an undercut area formed by a region of reduced external diameter 121 joined to a region of further reduced diameter 123. As shown in FIGS. 1 and 2 the undercut area of the mandrel 21 is suitably positioned to underly the setting nut 55 during the sliding movement of the mandrel 21 within the setting nut 55, whereby the reduced diameter region 121 underlies and retains the dogs 69, 77, 79 and 81 in the setting sleeve groove 87 when the mandrel 21 is in the running-in position and the further reduced diameter region 123 underlies and releases the dogs 69, 77, 79 and 81 from the groove 87 when the mandrel 21 is in the weight-set down position in FIG. 2.

By providing the setting nut connecting threads 57 as right hand release threads, the setting tool is releasable from the setting sleeve 15 by right hand rotation of the mandrel 21 when the mandrel is in the weight-set down position. When a load is present on the setting sleeve 15, as when running into the well bore, the setting nut 55 rests on the retaining nut 109 and the dogs 69, 77, 79 and 81 are engaged in the setting sleeve groove 87 to prevent relative movement between the connecting threads 55, 57. In the running-in position, either left or right hand torque can be applied to the mandrel and through the spline 97 and setting nut 55 to the setting sleeve 15 without releasing the setting nut 55.

The operation of the present invention will now be described. In a typical liner hanging operation the setting tool of the invention would be made up in a pipe string as shown in FIG. 1 by threading the upper end 23 onto the lower extent 27 of the pipe string 13 running to the surface. The setting nut 55 would be engaging the setting sleeve 15 by means of the right hand release connecting threads 57, 59. The weight of the liner hanger 125 which is suspended below the setting sleeve 15 would cause setting nut 55 to rest on retaining nut 109 as shown in FIG. 1. The region of reduced diameter 121 of the mandrel located beneath the dogs 69, 77, 79 and 81, as shown in FIG. 1, would retain the dogs 69 in groove 87 of setting sleeve 15, thereby preventing relative movement of the connecting threads 57, 59. Thus, in the running-in position shown in FIG. 1, the setting tool and liner hanger can be run into the well bore and left or right hand torque can be applied form the surface through the pipe string 13, mandrel splines 97, setting nut 55, and setting sleeve 15 to the liner hanger 125 to manipulate the hanger mechanism to hang a liner in the well bore.

Once the liner is hung in the conventional manner, as by setting gripping slips located along a portion of the liner hanger, weight is taken off the setting tool allowing weight-set down on the pipe string 13 from the surface. This action allows sliding movement of the mandrel 21 within the setting nut 55 whereby supporting shoulder 37 contacts the uppermost extent 63 of setting sleeve 15. The port 51 in lower extent 47 of supporting shoulder 37 allows any trapped well fluids in the annular space 49 to pass to the outside of the tool during the sliding movement of the mandrel 21. The weight of the pipe string above the setting tool is now carried on the supporting shoulder 37 and the bearing portion of the tool 41, 43 and 45 allows rotational movement of the mandrel 21 with respect to the stationary setting sleeve 15 without a load being imposed upon the connecting threads 57, 59.

With weight set-down on the tool, the further reduced diameter region 123 of the mandrel exterior underlies the dogs 69, 77, 79 and 81 allowing transverse sliding movement of the dogs within the openings 65 in the setting nut 55 which results in disengagement of the dogs 69, 77, 79 and 81 in the setting sleeve groove 87. The application of right hand torque from the surface through the pipe string is now transmitted through the splines 97 and axial grooves 83 in the setting nut 55 to cause relative movement between the setting nut connecting threads 57 and the internal connecting threads 59 of the setting sleeve 15. The application of right-hand torque thus causes the setting nut 55 to travel upward and become disengaged from the connecting threads 59 of the setting sleeve as best seen in FIG. 2. Once the setting nut 55 has been completely disengaged, the setting tool 11 can be pulled out of the setting sleeve 15 as shown in FIG. 3 and raised to the well surface.

An invention has been provided with significant advantages. The setting tool of the present invention can be run into the well bore and allows left or right hand torque to be applied from the surface to the setting sleeve to perform well bore operations without releasing the setting tool from the setting sleeve. By setting weight down on the setting tool, right hand torque can be applied from the surface to disengage the setting tool from the setting sleeve, allowing the setting tool to be withdrawn from the setting sleeve and raised to the surface. The provision of right hand set and right hand release in the same tool removes the possibility of unthreading tool joints in the pipe string during well bore manipulations. The design of the present setting tool provides right hand set and right hand release without the use of a J-pin mechanism or other engaging device which might weaken the connection between the setting tool and setting sleeve during manipulations prior to releasing the tool.

While the invention has been shown in only one of its forms, it will be appreciated that it is not thus limited but is susceptible to various changes and modifications without departing from the spirit thereof.

We claim:

1. A setting tool of the type adapted to be made up in a pipe string for releasably engaging a setting sleeve in a well bore, comprising:

a mandrel having an upper end adapted to be connected in the pipe stirng, a lower end, and an intermediate supporting shoulder formed on the exterior of said mandrel;

a generally cylindrical setting nut carried on said mandrel, said nut having external connecting threads for engaging mating internal connecting theads on the interior of a setting sleeve disposed about the lower end of said mandrel and said setting nut having at least one axial groove in the interior thereof:

said mandrel being slidably disposed within said setting nut when said nut is engaging said setting sleeve, said mandrel being slidable between an extended runnin-in position and a weight set-down position wherein said supporting shoulder contacts said setting sleeve;

said setting nut having at least one opening in a sidewall thereof for receiving a dog and wherein said setting sleeve interior has a radial groove adapted to engage said dog for preventing relative movement between said connecting threads of said setting nut and said setting sleeve when said mandrel is in said extended running-in position and allowing relative movement between said connecting threads when said mandrel is in said weight set-down position; and at least one torque transmitting spline on said mandrel exterior adapted to be received within said setting nut axial groove whereby torque transmitted to said mandrel is transmitted to said setting nut.

2. The setting tool of claim 1, further comprising:

retaining means located on said mandrel lower end for supporting said setting nut when said setting nut is engaging said setting sleeve in said running-in position.

3. The setting tool of claim 2, wherein said mandrel exterior between said supporting shoulder and said retaining means comprises an undercut area formed by a region of reduced external diameter joined to a region of further reduced diameter, said undercut area of said mandrel being suitably positioned to underlie said setting nut during sliding movement of said mandrel within said setting nut, whereby said reduced diameter region underlies and retains said dog in said setting sleeve groove when said mandrel is in said running-in position and said further reduced region underlies and releases said dog from said groove when said mandrel is in said weight set-down position.

4. The setting tool of claim 3, wherein said setting nut connecting threads are right hand release threads, whereby said setting tool is releasable from said setting sleeve by right hand rotation of said mandrel when said mandrel is in said weight set-down position.

5. The setting tool of claim 4, wherein said supporting shoulder on said mandrel comprises an upper bearing race, a lower bearing race, and a plurality of balls therebetween.

6. The setting tool of claim 5, wherein said dog in said setting nut has a through bore therein to allow the passage of fluid from the interior to the exterior of said setting nut during sliding movement of said mandrel in said nut.

7. A method of releasing a setting tool of the type adapted to be made up in a pipe string in a well bore from a setting sleeve, comprising the steps of:

providing a mandrel having an upper end adapted to be connected in the pipe string and having a lower end;

providing a generally cylindrical setting nut carried on said mandrel, said nut having right hand external connecting threads for engaging mating internal connecting threads on the interior of a setting sleeve disposed about the lower end of said mandrel and said setting nut having at least one axial groove in the interior thereof;

slidably disposing said mandrel within said setting nut when said nut is engaging said setting sleeve, said mandrel being slidable between an extended running-in position and a weight set-down position:

said setting nut being provided with at least the opening in a sidewall thereof for receiving a dog and said setting sleeve interior being provided with a radial groove adapted to engage said dog for preventing relative movement between said connecting threads when said mandrel is in said extended running-in position and allowing relative movement in said weight set-down position, said dog and groove together comprising latch means for preventing relative movement between said connecting threads of said setting nut and said setting sleeve when said mandrel is in said extended, running-in position;

providing torque transmitting means on said mandrel for transmitting torque to said setting nut;

running said setting tool into the well bore with said mandrel in said extended position and a setting sleeve engaged below said tool by said connecting nut;

manipulating said setting sleeve to perform well bore operations by applying right hand torque to said pipe string from the surface;

setting weight down on said pipe string form the surface;

applying right hand torque to said tool through said pipe string to release said setting tool from said setting sleeve.

8. The method of claim 7, further comprising the step of providing retaining means located on said mandrel lower end for supporting said setting nut when said setting nut is engaging said setting sleeve in said running-in condition.

9. The method of claim 8, wherein said mandrel is provided with a supporting shoulder and wherein said mandrel exterior between said supporting shoulder and said retaining means is provided with an undercut area formed by a region of reduced external diameter joined to a region of further reduced diameter, said undercut area of said mandrel being suitably positioned to underlie said setting nut during sliding movement of said mandrel within said setting nut, whereby said reduced diameter region underlies and retains said dog in said setting sleeve groove when said mandrel is in said running in position and said further reduced region underlies and releases said dog from said groove when said mandrel is in said weight set-down position.

* * * * *